US009359053B2

(12) United States Patent
Hughes

(10) Patent No.: US 9,359,053 B2
(45) Date of Patent: Jun. 7, 2016

(54) PROPELLER COVER

(71) Applicant: PROP R SAFETY, LLC, Greensboro, NC (US)

(72) Inventor: Knox Hughes, Greensboro, NC (US)

(73) Assignee: PROP R SAFETY, LLC, Greensboro, NC (US)

( * ) Notice: Subject to any disclaimer, the term of this patent is extended or adjusted under 35 U.S.C. 154(b) by 0 days.

(21) Appl. No.: 14/177,691

(22) Filed: Feb. 11, 2014

(65) Prior Publication Data

US 2014/0224168 A1 Aug. 14, 2014

Related U.S. Application Data

(60) Provisional application No. 61/763,135, filed on Feb. 11, 2013.

(51) Int. Cl.

| | |
|---|---|
| ***B63H 5/16*** | (2006.01) |
| *B63H 20/36* | (2006.01) |
| *B63H 20/00* | (2006.01) |

(52) U.S. Cl.
CPC ..... *B63H 5/165* (2013.01); *B63H 20/36* (2013.01); *B63H 2020/008* (2013.01)

(58) Field of Classification Search
CPC ... B63H 5/165; B63H 20/36; B63H 2020/008
USPC ..... 114/361; 440/71, 72
See application file for complete search history.

(56) References Cited

U.S. PATENT DOCUMENTS 2,815,785 A * 12/1957 Vail ..... 383/13
3,870,875 A * 3/1975 Altimus ..... 362/477
3,993,016 A * 11/1976 Pulaski ..... 116/2
4,045,122 A 8/1977 Burdick
4,979,833 A * 12/1990 Cook ..... 383/12
5,135,222 A * 8/1992 Spector ..... 473/576
5,222,802 A * 6/1993 Beck ..... 362/156
5,246,345 A 9/1993 Adams, Jr.
5,273,399 A 12/1993 Ojeda
5,470,262 A 11/1995 Bustillo
5,527,193 A 6/1996 Doelcher
5,664,975 A 9/1997 Carlisle
5,688,152 A 11/1997 Rodskier (Continued)

OTHER PUBLICATIONS

"Black Porthole Mesh Fabric," [online] [retrieved on Jan. 8, 2016] retrieved from http://www.nancysnotions.com/product/black+porthole+mesh+fabric.do, 1 page.

(Continued)

*Primary Examiner* — Daniel V Venne

(74) *Attorney, Agent, or Firm* — Smith Moore Leatherwood LLP; Kimberly B. Gatling

(57) ABSTRACT

A cover for a propeller, such as a boat propeller, including a face having a topside and an underside, and a sidewall having a first edge and a second edge. The first edge is affixed to the face on substantially all edges of the face, and the second edge forms a channel for enclosing a cord. A stretchable and flexible mesh forms at least a portion of said sidewall that facilitates air flow in the cover. The second edge of the sidewall defines an opening into an interior cavity formed by the sidewall and the underside of the face, and the cord functions as a drawstring that enables a user to adjust a size of the opening during application and removal of the cover from the propeller.

12 Claims, 4 Drawing Sheets

(56) References Cited

U.S. PATENT DOCUMENTS

| | | | | |
|---|---|---|---|---|
| 5,868,189 | A * | 2/1999 | Jarvis | 150/165 |
| 6,086,438 | A | 7/2000 | Wang | |
| 6,092,932 | A * | 7/2000 | Pekala et al. | 383/75 |
| 6,152,064 | A | 11/2000 | Morton | |
| 6,190,220 | B1 | 2/2001 | Borrelli | |
| 6,736,686 | B2 | 5/2004 | Miller | |
| 6,896,565 | B2 * | 5/2005 | Kliewe | 440/72 |
| 6,916,217 | B1 * | 7/2005 | Crepeau | 440/71 |
| 7,244,153 | B2 | 7/2007 | Lobrovich | |
| 7,413,077 | B2 | 8/2008 | Rydberg et al. | |
| 8,070,541 | B2 * | 12/2011 | Novack, IV | 440/71 |
| 8,100,652 | B2 * | 1/2012 | Bauer et al. | 416/62 |
| 8,257,121 | B2 | 9/2012 | Taylor | |
| 8,590,470 | B2 | 11/2013 | Ploch | |
| 8,684,061 | B2 * | 4/2014 | Porter, IV | 160/10 |
| 2003/0017763 | A1 * | 1/2003 | Miller | 440/71 |
| 2005/0066874 | A1 | 3/2005 | Tonokaboni et al. | |
| 2007/0128045 | A1 | 6/2007 | McNerney | |
| 2008/0006637 | A1 * | 1/2008 | Feeney | 220/495.06 |
| 2012/0009236 | A1 * | 1/2012 | Eyster et al. | 424/402 |

OTHER PUBLICATIONS

"100 Denier 100% Polyester Porthole Mesh," [online] [retrieved on Jan. 8, 2016] retrieved from http://www.rockywoods.com/Mesh-Fabrics/100-Denier-Polyester-Porthole-Mesh, 2 pages.

"Mesh Gear Bag," ROKA Sports, [online] [retrieved on Jan. 8, 2016] retrieved from http://www.rokasports.com/products/mesh-gear-bag, 2 pages.

* cited by examiner

PROPELLER COVER

This application claims the benefit of U.S. Provisional Application No. 61/763,135, filed Feb. 11, 2013, the disclosure of which is expressly incorporated herein by reference.

The present invention relates to a cover for a propeller, such as the propeller of a motorized boat.

BACKGROUND OF THE INVENTION

Many boat owners transport their boats by towing them on a trailer that is pulled by a vehicle. When the boat is secured to the trailer for towing, it is common for the boat's propeller, located at the rear end of the boat, to overhang and extend beyond the edge of the trailer. Any overhang of the propeller creates a roadway safety hazard. For example, it is very difficult for drivers of vehicles traveling behind the boat towing vehicle to determine the depth of the propeller's overhang so the driver can determine the distance he or she needs to maintain between the vehicles. Without sufficient notice of the depth, a vehicle traveling behind the boat towing vehicle may not maintain a safe enough distance to keep from hitting the rear of the boat and trailer. This is even more of a hazard when traveling on an interstate at high speeds or at night. Some state statutes and regulations require that any trailer overhang be marked with some identification, such as an orange or red flag. However, these statues and regulations are rarely enforced. Additionally, the use of a flag is still insufficient to warn other drivers of the depth and size of a propeller overhang.

BRIEF SUMMARY OF THE INVENTION

A cover for a propeller including a face having a top side and an underside, and a sidewall having a first edge and a second edge. The first edge of the sidewall is affixed to the face on substantially all edges of the face, and the second edge of the sidewall forms a channel for enclosing a cord. A stretchable and flexible mesh forms at least a portion of the sidewall, wherein the second edge of the sidewall defines an opening into an interior cavity formed by the sidewall and the underside of the face, and wherein the cord functions as a drawstring that enables a user to adjust a size of the opening during application and removal of the cover from the propeller.

The second edge of the sidewall is folded over and affixed to itself to form the channel for enclosing the cord. The face is formed of a flexible and water-resistant material that may be formed from nylon, polyester, or acrylic. The face is preferably colored fluorescent orange and may include at least one reflective tape strip that is affixed to the face and/or the sidewall.

The sidewall may be a porthole mesh that flexible and stretchable. The mesh may include nylon or polyester fibers. The cord may be a shock cord and may be affixed to a device that secures a position of the cord, such as a cord clincher, cord lock or slide lock.

The present invention further provides a cover for a propeller including a substantially circular face, the face having a top side and an underside, and a stretchable and flexible mesh having a first edge and a second edge. The first edge of the mesh is affixed to the face on substantially all edges of the face, and the second edge forms a channel for enclosing a drawstring. The second edge of the mesh, as enclosing the drawstring, defines an opening into an interior cavity formed by the mesh and the underside of the face. The drawstring enables a user to adjust a size of the opening during application and removal of the cover from the propeller.

DETAILED DESCRIPTION OF THE INVENTION

The accompanying drawings and the description which follows set forth this invention in its preferred embodiment. However, it is contemplated that persons will be able to apply the novel characteristics of the structures illustrated and described herein in other contexts by modification of certain details. Accordingly, the drawings and description are not to be taken as restrictive on the scope of this invention, but are to be understood as broad and general teachings.

Figure 1:
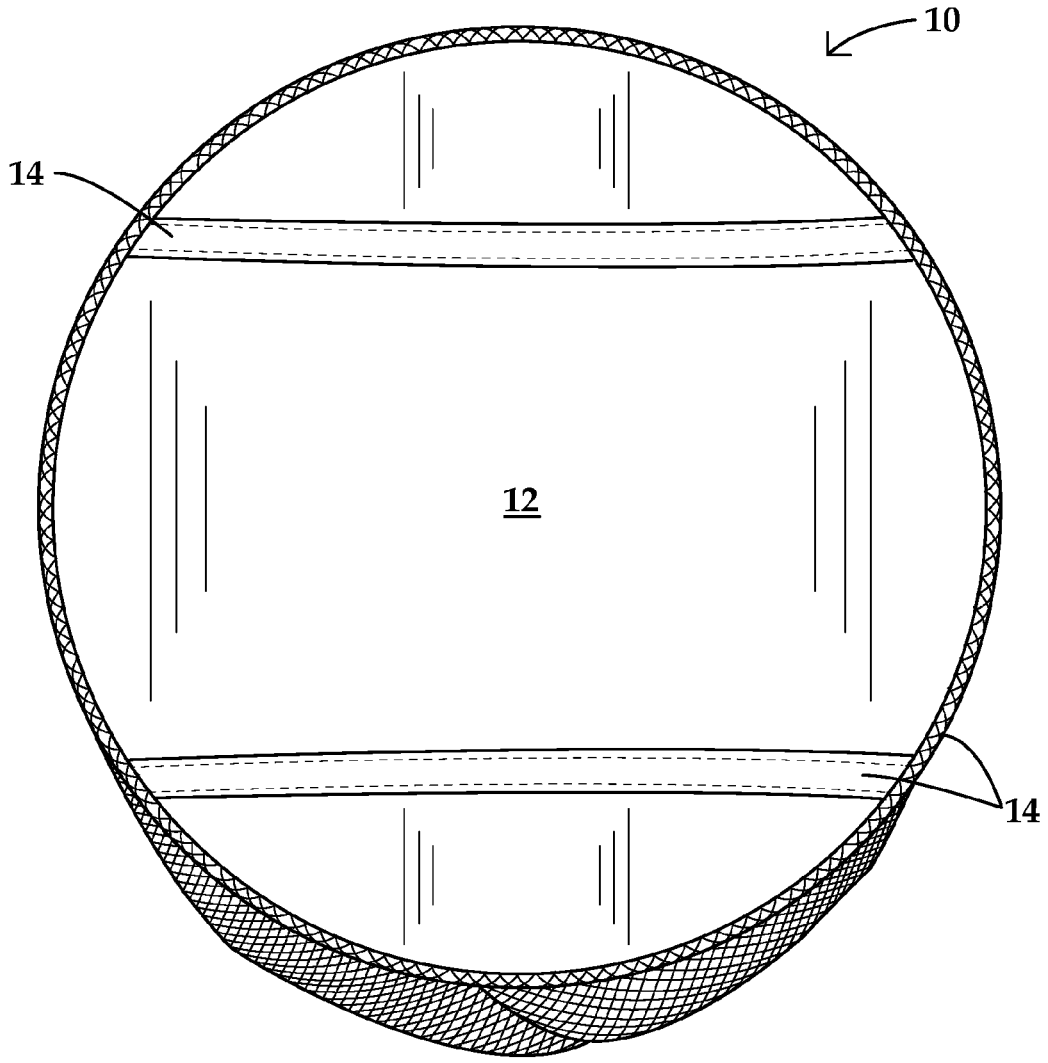
FIG. 1 depicts the front face of a propeller cover in accordance with an embodiment of the present invention.

The present invention overcomes the deficiencies cited above by providing a cover 10 for a boat propeller that provides distinctive notice of the propeller, particularly when the boat is loaded on a trailer and the propeller overhangs the end of the trailer. As shown in FIG. 1, the face 12 of the propeller cover 10 is generally round in shape to accommodate the shape of a traditional boat propeller that rotates in a circular motion. It is noted, however, that the cover 10 may be manufactured in various shapes and sizes to accommodate varying propeller types and sizes.

In the embodiment depicted in FIG. 1, the face 12 of the propeller cover 10 is constructed of a durable and flexible material that is capable of withstanding weather elements and repeated application to, and removal from, a propeller. Suitable materials may include nylon, polyester, or acrylic, such as nylon PVC backed denier. It is preferable that the material comprising the face 12 of the cover 10 be water resistant or water repellant. The face 12 may also be manufactured in a plurality of colors. The color orange, such as fluorescent orange, may be preferable because it is distinctive and also complies with some state statutes and regulations as an appropriate color indicating an overhang on a trailer. In some embodiments, the face 12 may be manufactured in colors representing sports teams, school colors, marinas, boat manufacturers, and the like. Any desired words or designs may be printed on the face 12, such as a sports team or school logo. Additionally, reflective tape 14 may be sewn onto any part of the face 12, such as around the perimeter of the face 12, so that the cover 10 illuminates when exposed to light. This is particularly helpful for boat towing in the dark and provides an additional means for warning other vehicles of the propeller.

Figure 2:
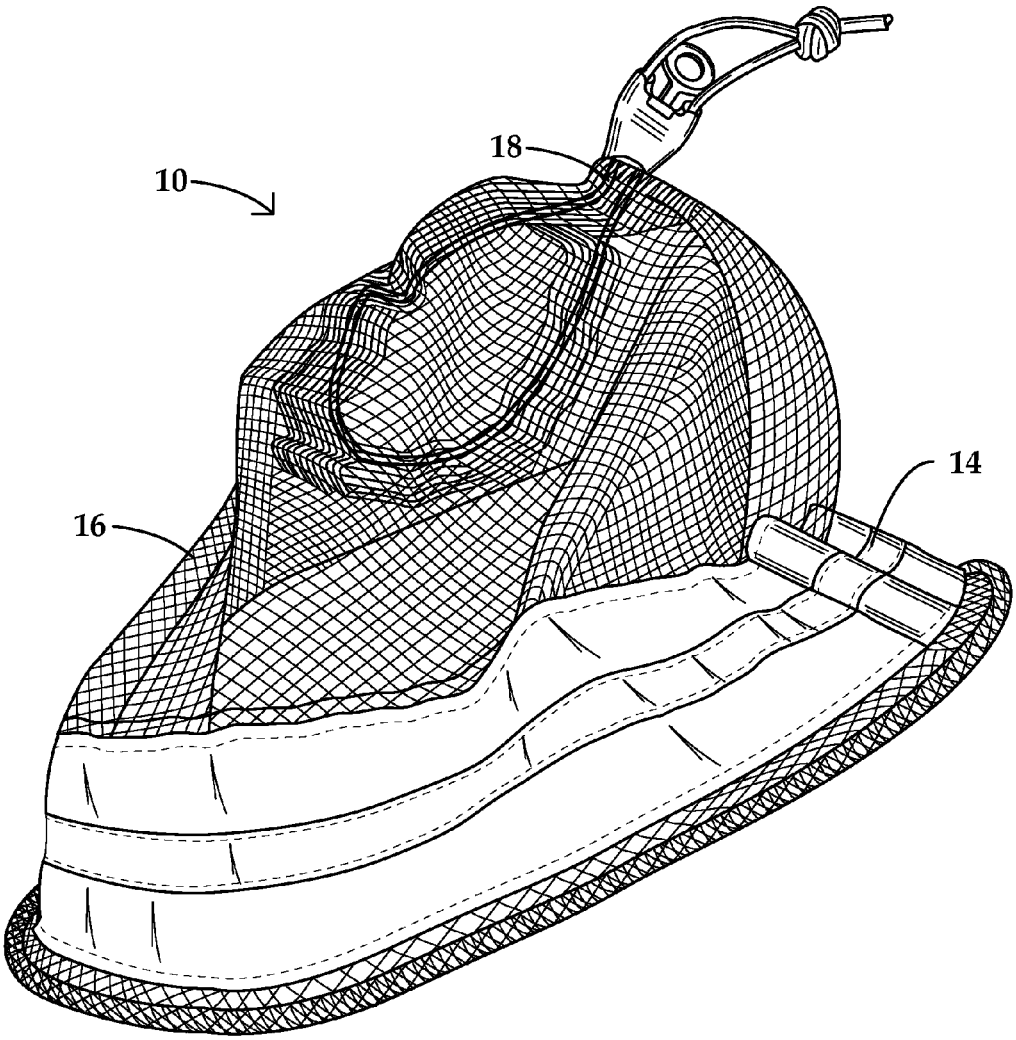
FIG. 2 depicts a perspective side view of the propeller cover of FIG. 1 in a tightened position wherein the front face is down.
Figure 3:
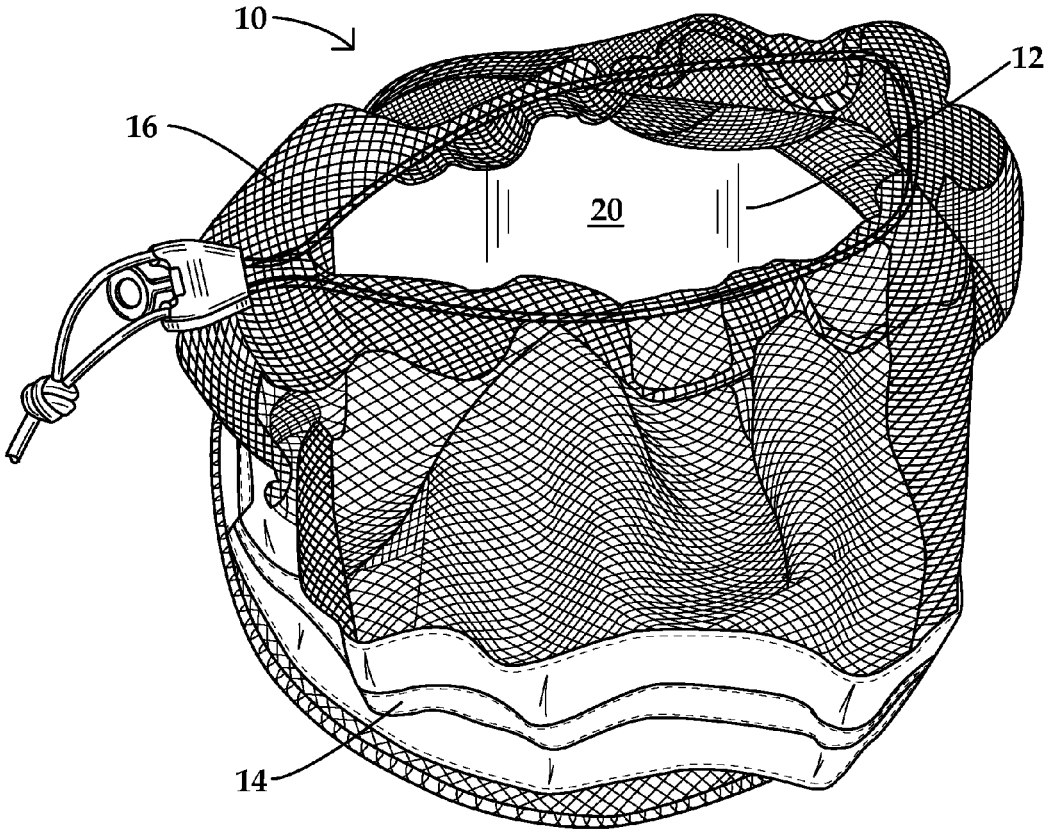
FIG. 3 depicts a perspective side view the propeller cover of FIG. 1 in a loosened position wherein the front face is down.

Referring now to FIGS. 2 and 3, the back of the propeller cover 10 is formed with a heavyweight porthole mesh 16 that may be constructed of nylon or polyester, for example. The mesh 16 may be affixed directly to the face 12 on all substantially edges of the face 12 to form a sidewall. In one embodiment, the mesh 16 on the back of the cover 10 may be interrupted by a segment of material similar to the material forming the face 12 and reflective tape 14 may be affixed to that segment of material, as shown in FIGS. 2 and 3. In an alternative embodiment, a segment of the same material as the face 12 may be affixed to the periphery of the face 12 and then affixed to the mesh 16 to collectively form the annular sidewall.

The mesh 16 provides an effective way for the propeller to be exposed to air to dry when it the boat is taken out of the water, without the need for providing an aperture in the propeller cover to drain any collected water. Additionally, the stretchable and flexible mesh 16 enables the propeller cover 10 to be easily stretched to fit around various propeller shapes and sizes. In the embodiment shown in the Figures wherein the face 12 of the propeller cover 10 is substantially round, the mesh 16 sidewall also has a generally circular perimeter. Any known means may be utilized for securing the sidewall to the face 12 provided that it creates a durable seam. Suitable stitching includes an over lock stitch pattern, a straight needle stitch, or any other typical stitch pattern.

Figure 4:
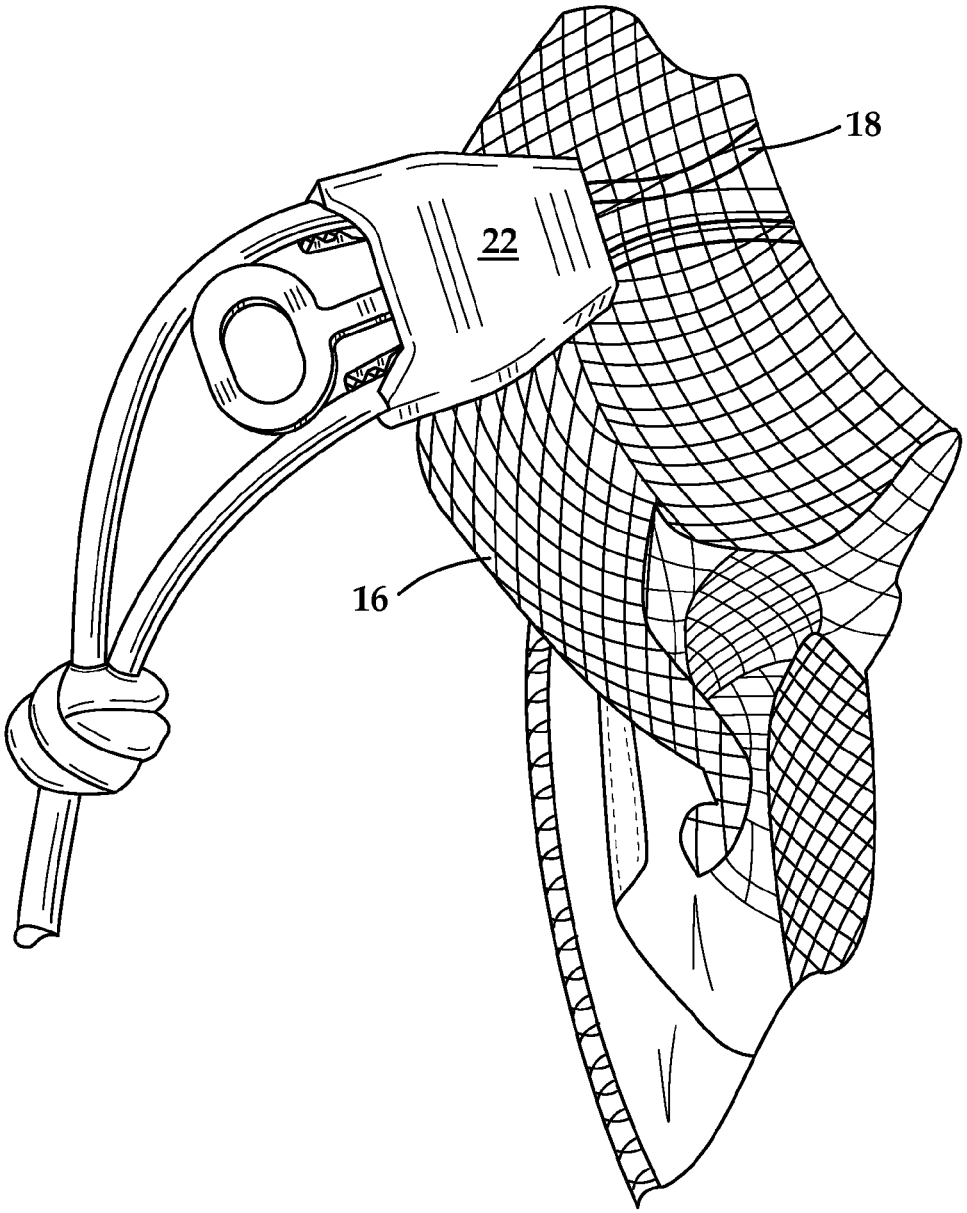
FIG. 4 depicts a close-up view of the cord and clincher of the propeller cover of FIGS. 1 and 2.

The edge of the sidewall (mesh 16 as shown in the Figures) opposite the edge affixed to the face 12 is folded over and affixed to itself to create a channel for enclosing a cord 18, such as a shock cord. The folded edge of the sidewall enclosing the cord 18 defines an opening 20 into an interior cavity formed by the sidewall (mesh 16 as shown in the Figures) and the underside of the face 12. In a preferred embodiment, the cord 18 functions as a drawstring that permits controlled tightening and loosening of the cord 18. For example, the ends of the cord 18 extending from the mesh 16 may be affixed to a device that secures the ends of cord 18, such as a cord lock, slide lock, or cord clincher 22, such as a ring pull cord clincher 22 shown in FIG. 4. The cord 18 and clincher 22 form a drawstring assembly that permits the user to loosen and tighten the opening 20 by pulling or releasing the cord 18 and securing its position with the clincher 22. For example, when a user desires to apply the cover 10 to a propeller, he or she loosens the cord 18 to lengthen the diameter of the opening 20, as shown in FIG. 3, so that it will fit around the propeller for application. The mesh 16 is flexible and stretchable so it expands to aid the user in applying the cover 10. Once the cover 10 is fitted around the propeller, the user tightens the opening 20 by pulling the cord 18 and securing it with the clincher 22 such that the opening 20 snugly fits around the base of the propeller (see FIG. 2 showing the opening 20 tightened to a substantially closed position). In order to remove the propeller cover 10, the user again loosens the cord 18 from the clincher 22 to lengthen the diameter of the opening 20 so the cover 10 can be stretched over the propeller for removal.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the present disclosure.

What is claimed is:

1. A cover for a propeller comprising:

a face having a topside and an underside; and a sidewall having a first edge and a second edge, the first edge being affixed to the face on substantially all edges of the face, and the second edge forming a channel for enclosing a cord;

wherein a stretchable and flexible mesh forms at least a portion of the sidewall to allow air to flow into an interior of the cover and to allow water to drain from an interior of the cover;

wherein the second edge of the sidewall defines an opening into an interior cavity formed by the sidewall and the underside of the face; and wherein the cord functions as a drawstring that enables a user to adjust a size of the opening.

2. The cover of claim 1 wherein the second edge of the sidewall is folded over and affixed to itself to form the channel for enclosing the cord.

3. The cover of claim 1 wherein the face is comprised of a flexible and water-resistant material.

4. The cover of claim 3 wherein the flexible and water-resistant material is chosen from nylon, polyester, or acrylic.

5. The cover of claim 1 wherein the face is colored orange or red.

6. The cover of claim 1 further comprising at least one reflective tape strip that is affixed to the face.

7. The cover of claim 1 further comprising at least one reflective tape strip that is affixed to the sidewall.

8. The cover of claim 1 wherein the mesh is a porthole mesh.

9. The cover of claim 1 wherein the mesh is chosen from nylon and polyester.

10. The cover of claim 1 wherein the cord is a shock cord.

11. The cover of claim 1 wherein the cord is affixed to a device that secures a position of the cord, said device chosen from a cord clincher, cord lock and slide lock.

12. A cover for a propeller comprising:

a substantially circular face, the face having a topside and an underside; and a stretchable and flexible mesh having a first edge and a second edge to allow air to flow into an interior of the cover and to allow water to drain from an interior of the cover, the first edge being affixed to the face on substantially all edges of the face, and the second edge forming a channel for enclosing a drawstring;

wherein the second edge of the mesh, as enclosing the drawstring, defines an opening into an interior cavity formed by the mesh and the underside of the face;

wherein the drawstring enables a user to adjust a size of the opening.

* * * * *